United States Patent [19]

Masuda et al.

[11] Patent Number: 4,962,408

[45] Date of Patent: Oct. 9, 1990

[54] DEVICE FOR REMOVING DEFECTIVE DEVELOPER AGENT FROM A DEVELOPING UNIT OF AN IMAGE FORMATION APPARATUS

[75] Inventors: Jitsuo Masuda, Yamatotakada; Junji Morimoto, Yamatokoriyama; Ken Yamagishi, Yamatotakada; Hiroshi Kinashi, Uji; Itaru Kawabata, Kashiwara; Teruhiko Noguchi, Sakai, all of Japan

[73] Assignee: Sharp Kabushiki Kaisha, Osaka, Japan

[21] Appl. No.: 185,027

[22] Filed: Apr. 22, 1988

[30] Foreign Application Priority Data

Apr. 23, 1987 [JP] Japan ..... 62-100261
May 1, 1987 [JP] Japan ..... 62-109572

[51] Int. Cl.[5] ..... G03G 15/06; G03G 21/00

[52] U.S. Cl. ..... 355/245; 355/296; 355/299

[58] Field of Search ..... 355/3 CH, 14 CH, 205, 355/206, 208, 245, 269, 296, 306, 299

[56] References Cited

U.S. PATENT DOCUMENTS

| | | | |
|---|---|---|---|
| 3,655,375 | 4/1972 | Madrid | 355/296 X |
| 3,834,804 | 9/1974 | Bhagat et al. | 355/306 |
| 3,920,329 | 11/1975 | Dennie et al. | 355/306 X |
| 3,947,108 | 3/1976 | Thettu et al. | 355/297 |
| 3,994,725 | 11/1976 | Volkers | 355/306 X |
| 4,139,300 | 2/1979 | Katayama et al. | 355/14 R |
| 4,142,792 | 3/1979 | Satomi et al. | 355/14 R |
| 4,201,465 | 5/1980 | Oyama et al. | 355/3 CH X |
| 4,205,912 | 6/1980 | Yamaguchi et al. | 355/3 CH X |
| 4,533,236 | 8/1985 | Garsin | 355/306 X |
| 4,621,920 | 11/1986 | Takahashi | 355/3 CH X |
| 4,761,671 | 8/1988 | Sadowski et al. | 355/296 |

*Primary Examiner*—Fred L. Braun

[57] ABSTRACT

An image formation apparatus having a cleaning process for removing defective toner from the developing unit during a non-image formation rotation of the photoreceptor drum. The image formation apparatus includes a reverse polarity charger for charging the photoreceptor drum to an opposite polarity from the polarity that is used for forming an electrostatic latent image. The reverse polarity charger allows defective toner to be removed from the surface of the photoreceptor during a warming-up process of the apparatus or after a predetermined number of image forming processes have been performed.

4 Claims, 7 Drawing Sheets

DEVICE FOR REMOVING DEFECTIVE DEVELOPER AGENT FROM A DEVELOPING UNIT OF AN IMAGE FORMATION APPARATUS

BACKGROUND OF THE INVENTION

The present invention relates to an image formation apparatus such as a copying machine based on electrophotography.

Conventionally, an image formation apparatus based on electrophotography is equipped with a developing unit in the vicinity of the photoreceptor drum surface. A developing agent is contained in the developing unit. The developing unit supplies the developing agent to the photoreceptor drum surface for forming an electrostatic latent image on the surface. When the developing agent is of two-component type including components of thermoplastic resin powder toner and magnetic fine particle carrier, the toner and the carrier are mixed together in the developing unit so that they induce frictional electric charge in each other, which causes the toner to adhere electrostatically to the carrier surface. The developing unit has an opening at a position facing the photoreceptor drum surface. A magnet roller is positioned in the developing unit so that the magnet roller faces to the photoreceptor drum surface through the opening. The carrier has toner adhering thereto, which sticks magnetically to the magnet roller surface. Thus, the developing agent made up of toner and carrier forms a magnetic brush between the photoreceptor drum and the magnet roller, so that the toner alone adheres to the electrostatic latent image formed on the photoreceptor drum. The potential for forming an electrostatic latent image is realized by charging the photoreceptor drum surface with an electric charger. Therefore, a corona discharge by the electric charger has an opposite polarity to the polarity of the potential of the friction-charged toner.

However, in the above conventional image formation apparatus using a two-component developing agent, the toner constituting the developing agent will become unevenly charged as the toner deteriorates with age. The toner may be charged to a potential of the reverse polarity. In the developing process, such defective toner sticks to an area other than the area having an electrostatic latent image on the photoreceptor drum. Consequently, the toner is transferred to the blank area or the background of an image on copy paper, and an image of poor quality results.

SUMMARY OF THE INVENTION

The object of the present invention is to provide an image formation apparatus which removes defective toner produced in the developing unit by making it adhere to the photoreceptor drum surface for producing an image of high quality.

According to one embodiment of the present invention, an image formation apparatus, which preliminarily rotates the photoreceptor drum during the warming up period, contains a reverse polarity charging device for charging the photoreceptor drum surface to a potential having an opposite polarity to the polarity of the potential for forming an electrostatic latent image while the photoreceptor drum is in a preparatory rotation.

According to another embodiment of the present invention, an image formation apparatus contains a reverse polarity charging device for charging the photoreceptor drum surface to a potential having an opposite polarity to the polarity of the potential for forming an electrostatic latent image. Also, the image formation apparatus contains a counter for counting the number of times that the image forming process is carried out, and the reverse polarity charging device is actuated for an area other than the area having an electrostatic latent image on the photoreceptor drum surface whenever the counter has counted up to the specified number.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
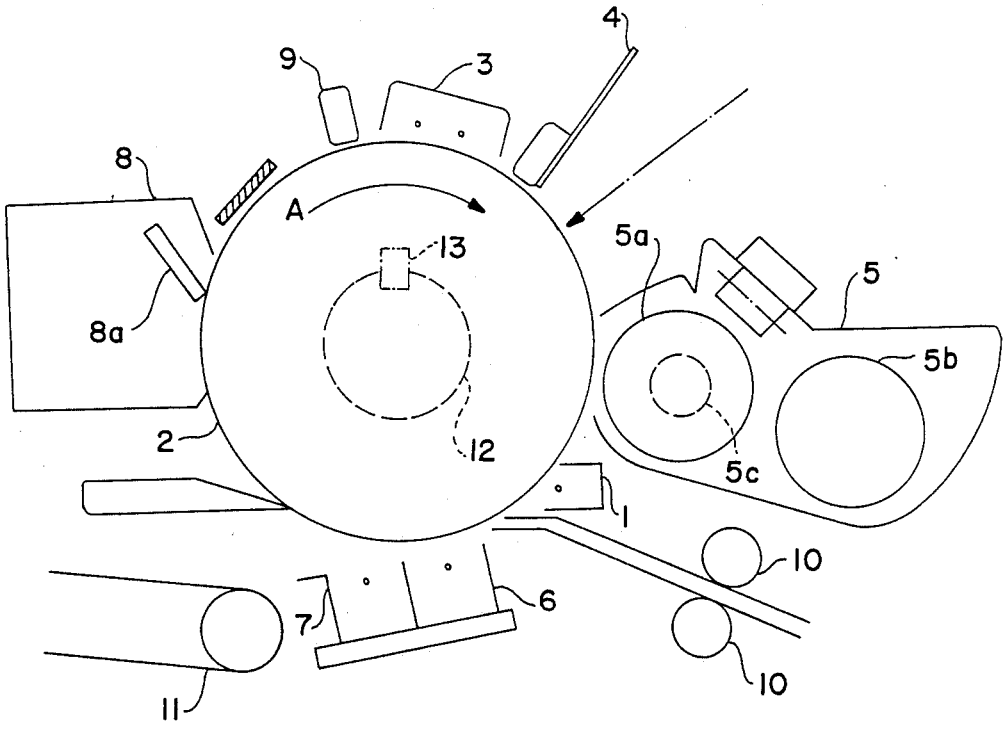
FIG. 1 is a schematic elevational view for a section of the essential part of the image formation apparatus of the first embodiment of the invention.

FIG. 1 is a schematic elevational view for a section of the essential part of the image formation apparatus of a first embodiment of the present invention.

A photoreceptor drum 2 is of a cylindrical shape and is supported rotatably on the frame. The photoreceptor drum 2 is given the rotation torque from a main motor (not shown). An electric charger 3, a blank lamp 4, a developing unit 5, a reverse polarity charger 1, a transfer charger 6, a separation charger 7, a cleaner 8 and a discharger lamp 9 are arranged along the circumference of the photoreceptor drum 2. The electric charger 3 provides a corona discharge to the photoreceptor drum 2 for charging the surface to a single polarity. The blank lamp 4 irradiates the blank area on the photoreceptor drum surface that does not correspond to the image on a manuscript. Light projected from an optical system (not shown) onto a manuscript is reflected by the manuscript surface and the light is distributed along the chain line to the image forming area of the photoreceptor drum 2. Thus, an electrostatic latent image is formed on the photoreceptor drum surface. The developing unit 5 supplies a developing agent to the electrostatic latent image for visualizing the image. The developing unit 5 contains a magnet roller 5a and a mixing roller 5b. The mixing roller 5b stirs the two-component developing agent in the developing unit 5 and charges the toner and the carrier by friction. The rotation torque is transmitted through a developing unit clutch 5c to the magnet roller 5a. A magnetic pole is provided in the magnet roller 5a so that a rotating field is formed around the magnet roller 5a as the roller 5a is rotating. The rotating field causes the carrier, which has the toner electrostatically adhering thereto, to stick to the magnet roller surface. Thus, the toner and the carrier form a magnetic brush on the magnet roller surface faced to the photoreceptor drum 2 for making the toner stick alone to the electrostatic latent image formed on the photoreceptor drum 2.

The toner image thus formed on the photoreceptor drum 2 faces the transfer charger 6 as the photoreceptor drum 2 rotates. The transfer charger 6 provides a corona discharge, which has the same polarity as the electric charger 3, to the copy paper. The corona discharge is transmitted by a pair of timing rollers 10, so that the toner image is transferred onto the copy paper. The separation charger 7 provides an AC corona discharge to the paper carrying the toner image for releasing the paper from the photoreceptor drum 2. The paper separated from the photoreceptor drum 2 is conveyed on a transfer belt 11 to a fixing device where the toner image is melted and fixed on the paper by heat and pressure.

The surface of the photoreceptor drum 2 faces a blade 8a provided in the cleaner for completing the transfer process. The toner remaining on the photoreceptor drum 2 is scraped by the blade 8a and drops downward. Then, this part of the photoreceptor drum surface is irradiated by the discharger lamp 9 for eliminating residual potential. A slit disc plate 12 is fixed to the rotary shaft of the photoreceptor drum 2. A plurality of slits are formed at regular intervals in the periphery of the slit disc plate 12. A photo-interrupter 13 is mounted to face one of the slits, so that the photo-interrupter 13 outputs a detection signal whenever a slit is detected.

Figure 2:
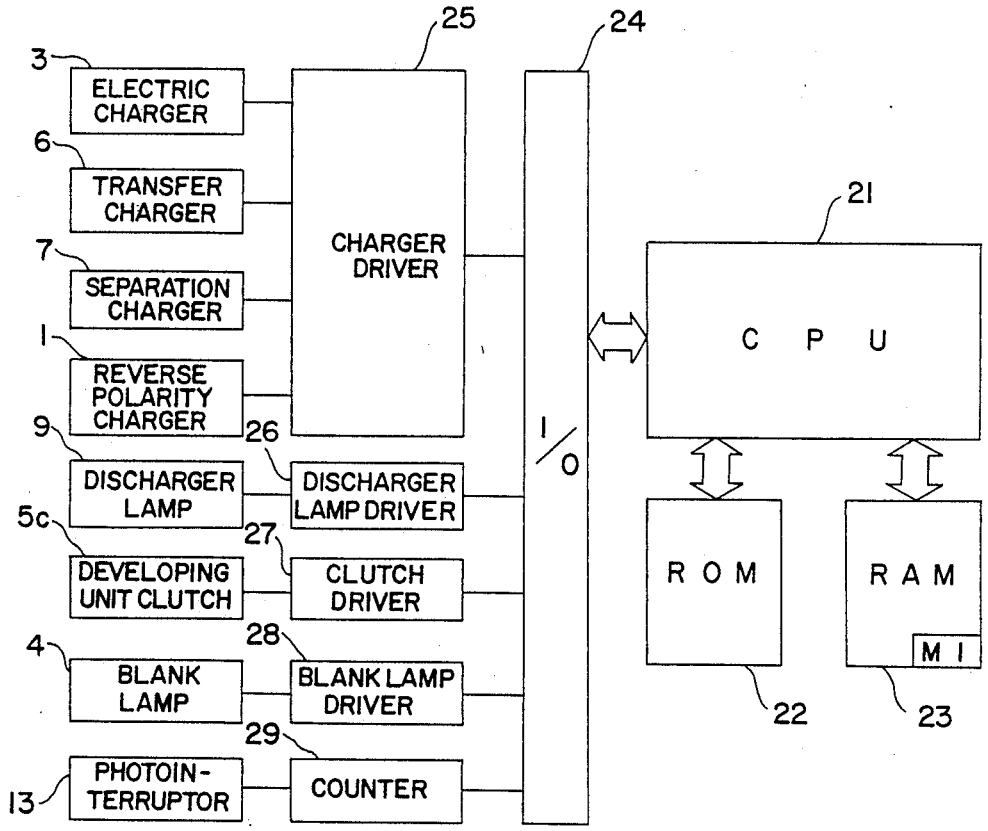
FIG. 2 is a block diagram showing the construction of a part of the controller of the image formation apparatus of the first embodiment.

FIG. 2 is a block diagram showing the construction for a part in the controller of the image formation apparatus of the first embodiment.

A CPU 21 is connected via an I/O interface 24 to each I/O device. According to the program stored in a ROM 22, the CPU 21 outputs control data to each I/O device. A portion in the memory area of a RAM 23 is allocated for the working area for this purpose. The I/O interface 24 is connected to a charger driver 25, a discharger lamp driver 26, a clutch driver 27, a blank lamp driver 28, a counter 29, etc. which constitute a portion of the I/O devices. Beside the above-mentioned I/O devices, a driver for the main motor and drivers for various other devices of the image formation apparatus are connected to the I/O interface 24.

The charger driver 25 is connected with the electric charger 3, the transfer charger 6, the separation charger 7 and the reverse polarity charger 1. The discharger lamp driver 26 is connected with the discharger lamp 9, the clutch driver 27 having the developing unit clutch 5c, and the blank lamp driver 28 with the blank lamp 4. The counter 29 counts detection signals output from the photo-interrupter 13. When the counter 29 has counted up to the specified number, the counter outputs a timing pulse to the CPU 21. Upon receipt of the timing pulse, the CPU 21 outputs control data to an appropriate I/O device. Therefore, operation of each I/O device of the image formation apparatus is synchronized with the rotation of the photoreceptor drum 2.

Figure 3:
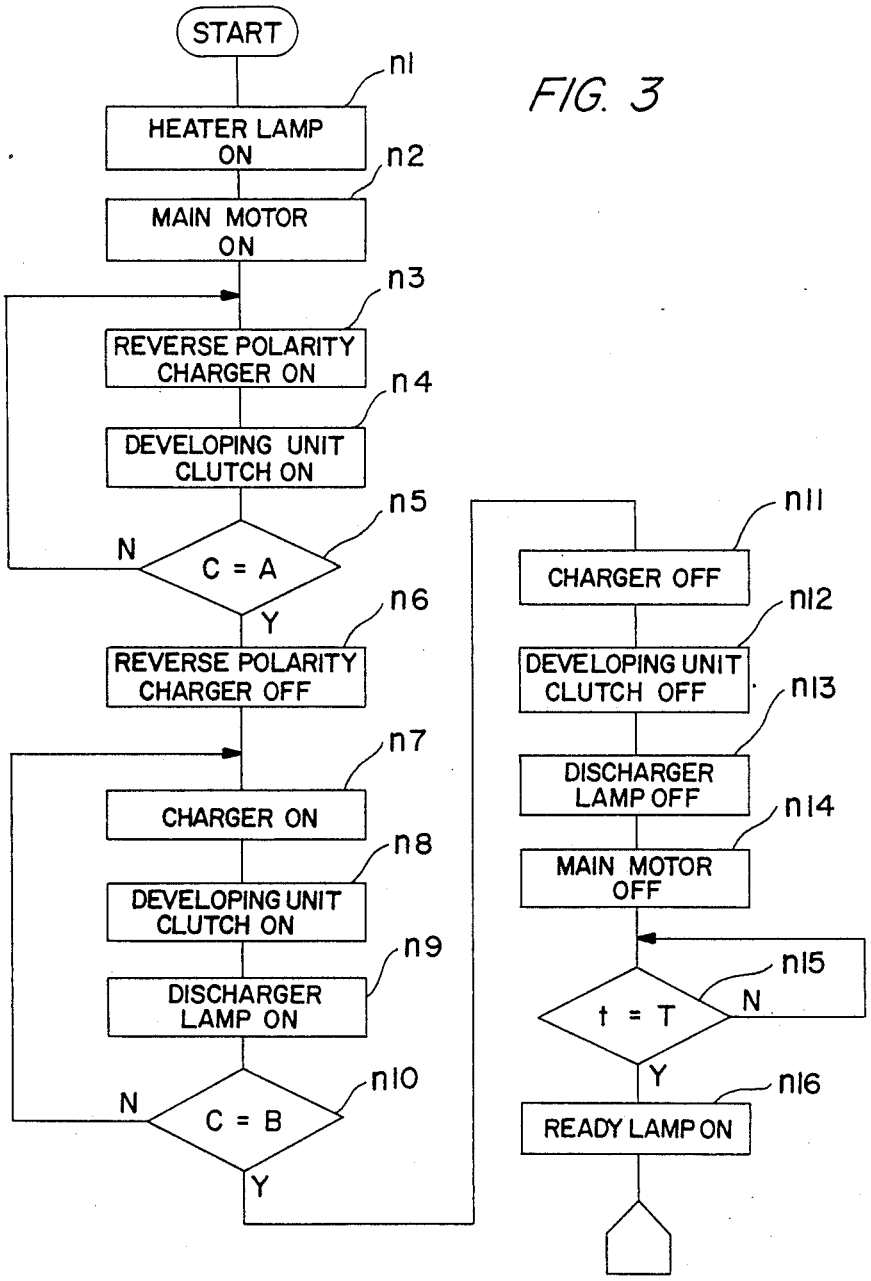
FIG. 3 is a flow chart for explaining a part of the operation process of the image formation apparatus of the first embodiment.

FIG. 3 is a flow chart for explaining a part of the operation process of the image formation apparatus.

When power is supplied to the apparatus, a heater lamp for heating up the fixing device is turned ON (n1). Then, the main motor drives the photoreceptor (N2) in a preparatory rotation. Simultaneously, the reverse polarity charger 1 and the developing unit clutch 5c are driven (n3 and n4). The reverse polarity charger 1 provides a corona discharge having an opposite polarity to the polarity of the corona discharge by the electric charger 3. Thereby, the photoreceptor drum 2 is charged to a potential having an opposite polarity to the polarity of the potential for forming an electrostatic latent image. Consequently, the photoreceptor drum 2 is charged to a potential of the same polarity as the polarity of the normal toner charged by friction with carrier.

As the photoreceptor drum 2 rotates in a direction indicated by the arrow "A" in FIG. 1, the surface portion charged to a potential of the opposite polarity to the potential for forming an electrostatic latent image faces the developing unit 5. The charge on the photoreceptor drum 2, the normal toner does not adhere to the photoreceptor drum 2 repels while defective toner which in the developing unit 5 is attracted and sticks to the photoreceptor drum 2. As the photoreceptor drum 2 rotates further in the direction of "A", the defective toner adhering to the photoreceptor drum surface is scraped by the blade 8a of the cleaner 8 and is stored in the cleaner 8. The above process in steps n3 and n4 continues until the content of the counter C in the memory area M1 of the RAM 23 becomes equal to the specified number "A" (n5). The process in steps n3, n4 and n5 corresponds to the reverse polarity charging of the present invention.

When the content of the counter C becomes equal to the specified value "A" and the photoreceptor drum 2 has rotated the specified number of times, the reverse polarity charger 1 is turned OFF (n6). Then, the electric charger 3, the transfer charger 6, the separation charger 7, the developing unit 5 and the discharger lamp 9 are actuated until the content of the counter C becomes equal to the specified value "B" (n7 through n10). Thus, as the photoreceptor drum 2 rotates the specified number of times, the normal image forming operation is carried out. When the photoreceptor drum 2 has rotated the specified number of times, all the devices related to the image forming process and as the main motor are turned OFF (n11 through n14). This completes the preparatory rotation of the photoreceptor drum 2.

When the temperature "t" of the heater lamp reaches to the reference value "T" (n15), a ready lamp lights, which indicates that the warming-up process is over (n16). At this stage, the image formation apparatus is ready for the image forming operation.

Figure 4:
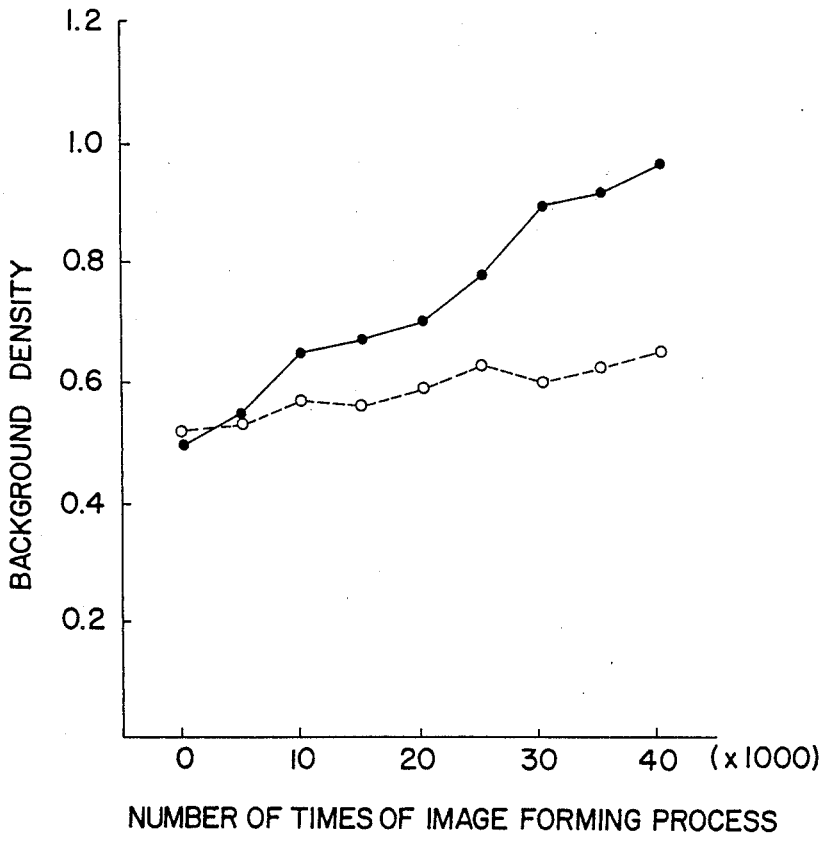
FIG. 4 compares the image formation apparatus of the first embodiment with a conventional image formation apparatus by the relation between the background density of an image on copy paper and the number of times that the image forming process is carried out.

According to the first embodiment of the present invention, as described above, a corona discharge is effected by the reverse polarity charger 1 to the photoreceptor drum for removing defective toner from the developing unit 5 during the preparatory warming-up rotation of the photoreceptor drum 2 conducted every time the power switch is turned ON. As a result, the image formation apparatus of the first embodiment effectively eliminates the possibility of forming an image of deteriorated quality, as shown in FIG. 4. FIG. 4 shows the relation between the background density of an image on copy paper and the number of times that the image forming process is carried out for the image formation apparatus of the first embodiment of the invention and a conventional image formation apparatus. With the conventional image formation apparatus, as indicated by the solid line in FIG. 4, the background density increases with the number of times that the image forming process is carried out. This is because defective toner produced in the developing unit 5 sticks to other portions than the portion having the electrostatic latent image on the photoreceptor drum 2 and the defective toner is transferred onto the paper during the image forming process.

In contrast, with the image formation apparatus of the first embodiment of the present invention, the background density is almost constant irrespective of the number of times that the image forming process is carried out, as indicated by the broken line in FIG. 4. The constant background density makes clear the contrast between the background and an image and an image of high quality results.

According to the first embodiment of the invention, the photoreceptor drum surface is charged by the reverse polarity charging means to a potential having an opposite polarity than to the potential for forming an electrostatic latent image while the photoreceptor drum is rotating preparatorily in the warming-up process. When the developing agent is supplied from the developing unit to the photoreceptor drum surface charged to the opposite polarity from to the charge for forming an electrostatic latent image, normal toner, which ordinarily sticks to an electrostatic latent image, is repelled by the photoreceptor drum surface. Whereas, defective toner charged insufficiently or charged to the opposite polarity from the normal toner is attracted and sticks to the photoreceptor drum surface. Since paper is not supplied during the preparatory rotation, the defective toner adhering to the photoreceptor drum surface is conveyed toward the cleaner and is scraped from the drum surface. In this way, defective toner produced in the developing unit is conveyed on the photoreceptor drum surface into the cleaner.

According to the first embodiment of the present invention, the reverse polarity charging means charges the photoreceptor drum to a potential having an opposite polarity to the polarity of the potential for forming an electrostatic latent image. This reverse polarity charging is performed during the preparatory rotation of the photoreceptor drum, so that defective toner is removed from the developing unit by making the defective toner stick to the photoreceptor drum surface. Since defective toner would adhere to a portion which does contain a latent image on the photoreceptor drum, defective toner can be removed from the developing agent before the normal image forming process is carried out and the image formation apparatus will continue to form an image of high quality. Moreover, the reverse polarity charging is performed during the preparatory rotation in the warming-up process. Since the apparatus is warmed up every time it is turned ON, defective toner is removed by the reverse polarity charging means every time the apparatus is turned ON. Thereby, the removal of the defective toner is ensured.

Figure 5:
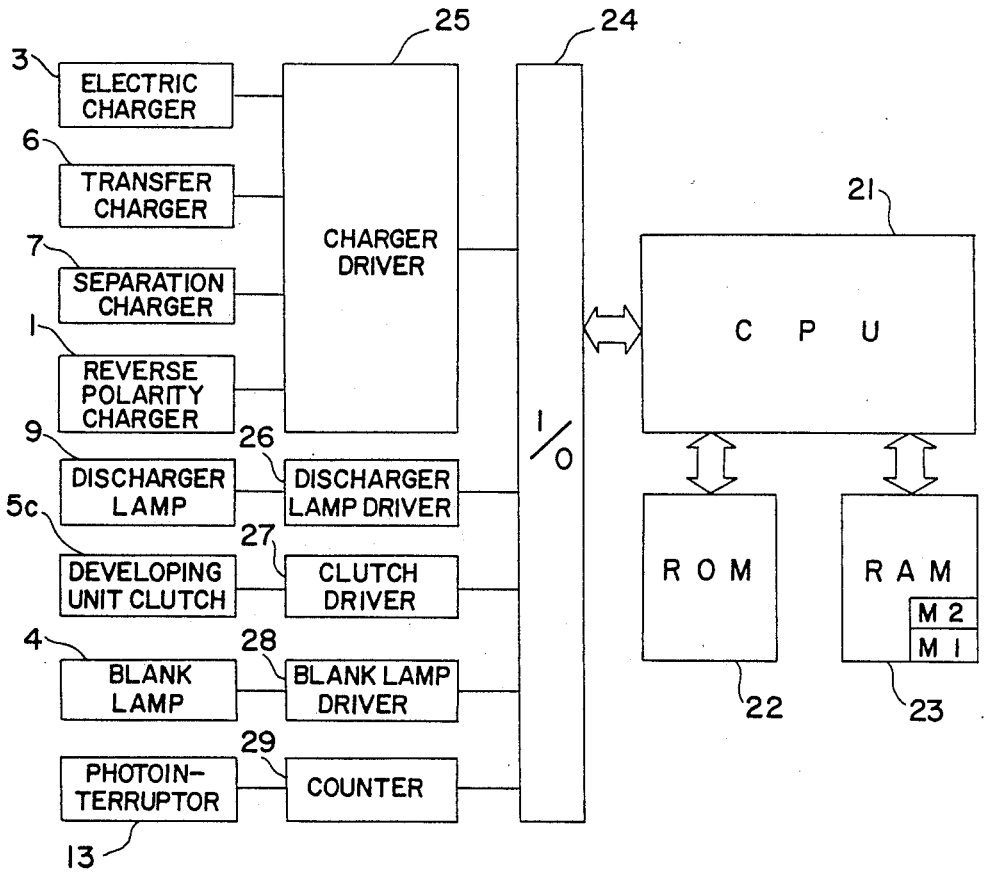
FIG. 5 is a block diagram showing the construction for a part in a controller of the image formation apparatus of the second embodiment of the present invention.

FIG. 5 is a block diagram showing the construction for a part of the controller of the image formation apparatus for second embodiment of the invention. The construction of the image formation apparatus in the second embodiment is similar to the construction of the first embodiment.

A CPU 21 is connected via an I/O interface 24 to each I/O device. According to the program stored in a ROM 22, the CPU 21 outputs control data to each I/O device. A portion of the memory area of a RAM 23 is allocated as the working area for this purpose. A memory area M1 of the RAM 23 is allocated for a counter "C" which will be described later. A memory area M2 of the RAM 23 is allocated for a counter "K" which will be described later. The I/O interface 24 is connected to a charger driver 25, a discharger lamp driver 26, a clutch driver 27, a blank lamp driver 28, a counter 29, etc. which constitute a portion of the I/O devices. Beside the above-mentioned I/O devices, a driver for a main motor and drivers for various other devices of the image formation apparatus are connected to the I/O interface 24.

The charger driver 25 is connected with the electric charger 3, the transfer charger 6, the separation charger 7 and the reverse polarity charger 1. The discharger lamp driver 26 is connected, with the discharger lamp 9, the clutch driver 27 having the developing unit clutch 5c, and the blank lamp driver 28 having the blank lamp 24. The counter 29 counts detection signals output from the photo-interrupter 13. When the counter 29 has counted up to the specified number, the counter outputs a timing pulse to the CPU 21. Upon receipt of the timing pulse, the CPU 21 outputs control data to an appropriate I/O device. Therefore, operation of each I/O device of the image formation apparatus is synchronized with the rotation of the photoreceptor drum 2.

Figure 6:
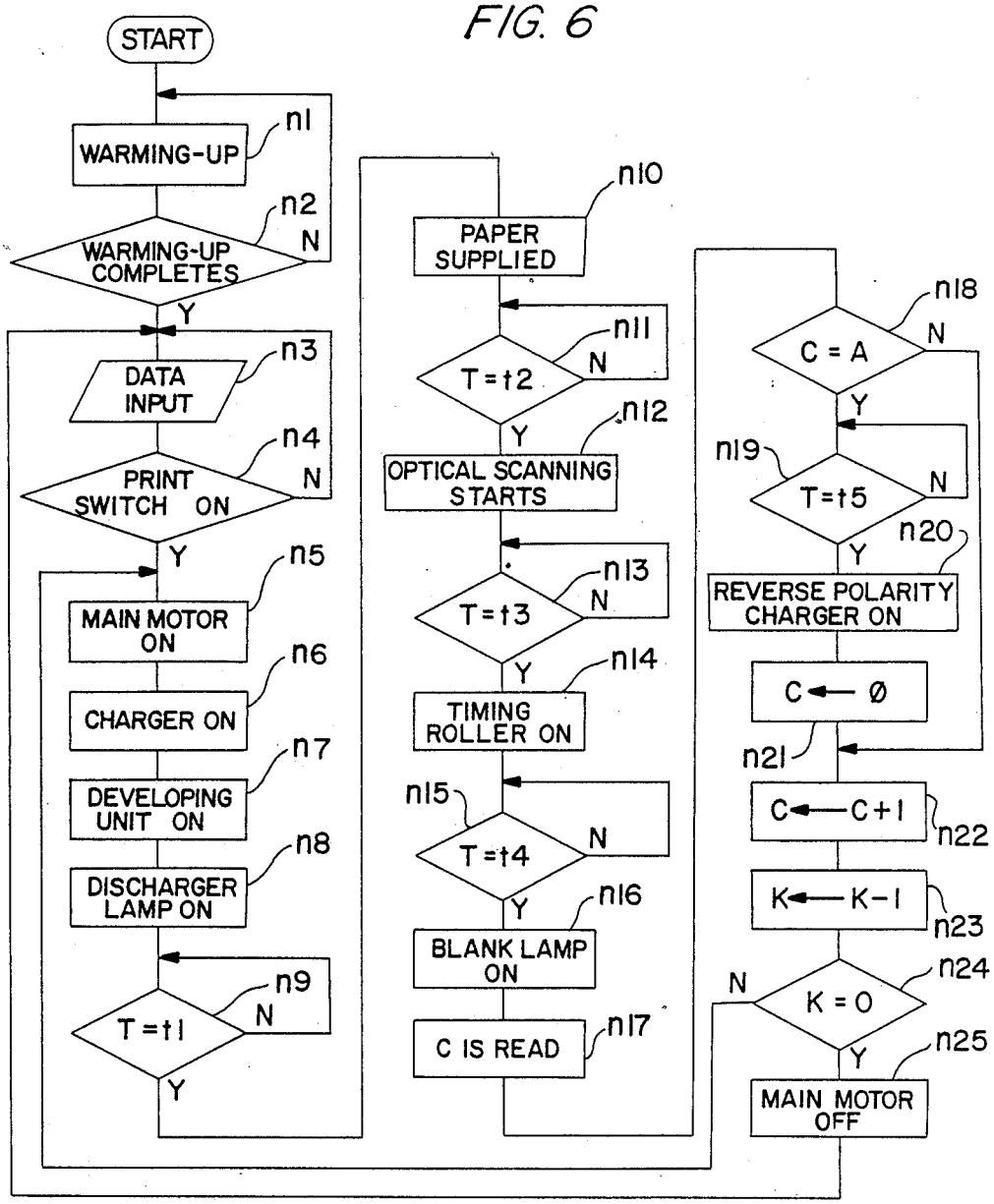
FIG. 6 is a flow chart for explaining the operation process of the image formation apparatus of the second embodiment.

FIG. 6 is a flow chart for explaining the operation process of the image formation apparatus of the second embodiment.

When power is supplied to the apparatus, a warming-up process is carried out (n1). When the warming-up process is completed (n2), data input is accepted until a print switch is operated (n3 and n4). When the print switch is operated, the main motor is turned ON (n5) and the photoreceptor drum 2 starts rotation. Simultaneously, the electric charger 3, developing the unit 5, the transfer charger 6, the separation charger 7, and the discharger lamp 8 are turned ON (n6, n7 and n8). When the specified time has elapsed (n9), paper is supplied from a paper feeder (not shown) (n10). Then after the specified time of period (n11), a manuscript is scanned by an optical system (n12). At the specified timing, the timing roller 10 is driven (n13 and n14) and the blank lamp 4 is actuated for an area other than that area having an electrostatic latent image on the photoreceptor drum surface (n15 and n16). In the process of the above steps n4 through n16, light projected from the optical system onto the manuscript is reflected by the manuscript surface and is distributed to the photoreceptor drum for forming an electrostatic latent image on the photoreceptor drum surface. The electrostatic latent image is made visible by the developing unit 5 so that a toner image is formed on the photoreceptor drum surface. The toner image is transferred by the transfer charger 6 onto the copy paper. Meanwhile, the blank lamp 4 irradiates the portion of the photoreceptor drum surface, which does not correspond to the image on the manuscript, and prevents unnecessary toner from sticking to this portion.

The CPU 21 reads the content of the counter C in the memory area M1 of the RAM 23 (n17). The counter C counts the number of times that the image forming process is carried out. It is then checked whether the content of the counter C is equal to the preset value "A" (n18). If the content of the counter C is not equal to "A", the content of the counter C is increased by one, and the content of the counter K in the memory area M2 is decreased by one (n22 and n23). The counter K counts down the number of copies to be made which was input in step n3. The process of the steps n5 through n23 is repeated until the counter K counts down to 0 (n24). When the content of the counter K becomes 0 or when the image forming process has been carried out for the preset number of copies, the main motor is turned OFF and the CPU 21 waits for data input for the next image forming process (n25→n3).

If the content of the counter C is equal to "A" in step n18, the reverse polarity charger 1 is turned ON at the specified timing (n19 and n20). Specifically, the reverse polarity charger 1 is turned ON when portion other than a portion having the electrostatic latent image on the photoreceptor drum 2 faces the reverse polarity charger 1. At the same time, the content of the counter C is cleared (n21). As mentioned above, when the content of the counter C conforms to the specified value "A", the reverse polarity charger 1 is actuated for an area of the photoreceptor drum surface which has no electrostatic latent image formed thereon. The reverse polarity charger 1 provides a corona discharge having an opposite polarity opposite to the polarity of the corona discharge by the electric charger 3. As a result, an area other than the area having the electrostatic latent image on the photoreceptor drum 2 is charged to a potential of an opposite polarity than the polarity of a potential for forming an electrostatic latent image. That is, the polarity of the potential is of the same polarity as the potential of the charged normal toner which should stick to the electrostatic latent image. When a portion other than the portion having electrostatic latent image on the photoreceptor drum 2 faces the developing unit 5, normal toner is repelled by the photoreceptor drum surface. Whereas, defective toner charged to a potential having a polarity opposite to the polarity of charged normal toner is attracted and adheres to the portion other than the portion having the electrostatic latent image on the photoreceptor drum 2. When the portion other than the area having an image formed thereon faces the cleaner 8, the defective toner adhering to the surface is scraped by the blade 8*a* and is stored in the cleaner 8.

Figure 7:
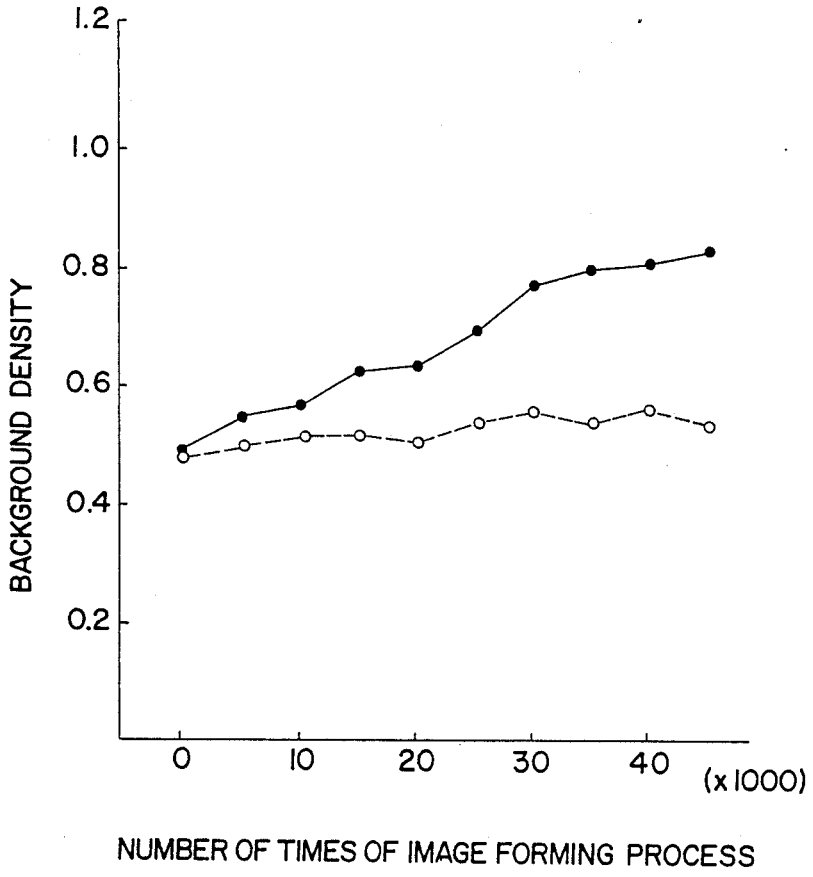
FIG. 7 compares the image formation apparatus of the second embodiment with a conventional image formation apparatus by the relation between the background density of an image on copy paper and the number of times that the image forming process is carried out.

Thus, the non-image forming area of the photoreceptor drum 2 is charged to a polarity opposite to the polarity of the image forming area for removing defective toner from the developing unit 5 every time the image forming process is carried out the specified number of times. As a result, a remarkable effect is obtained as shown in FIG. 7. Specifically, the conventional image forming apparatus does not remove defective toner produced in the developing unit, and the background density of an image on copy paper increases with the number of times that the image forming process is carried out, as indicated by the solid line. This is because defective toner sticks to the portion other than the portion having the electrostatic latent image on the photoreceptor drum and defective toner is transferred onto copy paper during the image forming process. In contrast, with the image formation apparatus of the second embodiment of the invention, the background density is almost constant as the number of copies increases, which is indicated by the broken line. This is because defective toner is removed from the developing unit every time the image forming process is carried out the specified number of times which prevent defective toner from sticking to the photoreceptor drum surface during the image forming process. The constant background density makes clear the contrast between the background and an image formed on paper and an image of high quality results.

In the above embodiment, a reverse polarity charger is used as reverse polarity charging means. Alternatively, the polarity of supply voltage applied to the electric charger may be reversed with the specified timing for obtaining the same effect by the reverse polarity charger. This alternative method can eliminate the reverse polarity charger, which results in cost reduction.

According to the second embodiment of the present invention, the number of times that the image forming process is carried out is counted by the counter. Each time the counter has counted up to the specified number, the reverse polarity charging means is actuated for the area of the photoreceptor drum surface which does not have an image formed thereon. The reverse polarity charging means charges the photoreceptor drum surface to a potential having a reverse polarity than the polarity of a potential for forming an electrostatic latent image on the photoreceptor drum. Therefore, the area other than the area having the electrostatic latent image on the photoreceptor drum surface is charged to a potential having an opposite polarity to a polarity for forming the electrostatic latent image every time the image forming process is executed the specified number of times. As a result, if the developing unit contains defective toner charged to a potential of the reverse polarity to the polarity of the normal toner, the defective toner is attracted and adheres to the surface other than the area having the electrostatic latent image region in order to be removed from the developing unit.

According to the second embodiment of the present invention, as mentioned above, whenever the counter has counted up to the specified number for the number of times that the image forming process is conducted, the area other than the area having an electrostatic latent image on the photoreceptor drum surface is charged by the reverse polarity charging means to the opposite polarity from the potential for forming the image, or namely, to the same polarity as the normal toner is charged. Therefore, the normal toner does not adhere to this area without an electrostatic latent image formed thereon. On the other hand, the defective toner charged to a potential of an opposite polarity from the polarity of the normal toner sticks to this area to be removed from the developing unit. Consequently, the background of an image on paper will not be soiled by defective toner in the subsequent image forming process because defective toner does not adhere to the photoreceptor drum surface. As a result, a clear image of high quality is formed on the paper.

While only certain embodiments of the present invention have been described, it will be apparent to those skilled in the art that various changes and modifications may be made therein without departing from the spirit and scope of the present invention as claimed.

What is claimed is:

1. An image formation apparatus for removing a defective developing agent of a first polarity accumulated during the formation of electrostatic latent images, comprising:

a photoreceptor having a surface for receiving electrostatic latent images;

a developing unit containing a developing agent to be applied to the surface of said photoreceptor;

counting means for counting the number of image formation processes that are performed by the apparatus;

reverse polarity charging means for charging the surface of said photoreceptor to a second polarity opposite from said first polarity and attracting the defective developing agent of the first polarity from said developing unit in response to said counting means counting that a predetermined number of image formation processes have been performed; and cleaning means for removing the defective developing agent of the first polarity from the surface of said photoreceptor.

2. An image formation apparatus as claimed in claim 1, wherein the developing agent comprises toner material and carrier material.

3. An image formation apparatus as claimed in claim 1, wherein said cleaning means comprises a blade for scraping the defective developing agent from the surface of said photoreceptor.

4. An image formation apparatus as claimed in claim 1, wherein said photoreceptor comprises a photoreceptor drum having a circumferential surface receiving electrostatic latent images.

* * * * *